US010793402B2

(12) United States Patent
Cazzaro

(10) Patent No.: US 10,793,402 B2
(45) Date of Patent: Oct. 6, 2020

(54) RETRACTABLE WARPING WINCH

(71) Applicant: HARKEN ITALY S.P.A., Limido Comasco (Como) (IT)

(72) Inventor: Michele Cazzaro, Besozzo (IT)

(73) Assignee: HARKEN ITALY S.P.A., Limido Comasco (Como) (IT)

( * ) Notice: Subject to any disclaimer, the term of this patent is extended or adjusted under 35 U.S.C. 154(b) by 55 days.

(21) Appl. No.: 16/292,829

(22) Filed: Mar. 5, 2019

(65) Prior Publication Data

US 2019/0276282 A1 Sep. 12, 2019

(30) Foreign Application Priority Data

Mar. 9, 2018 (IT) ..... 102018000003407

(51) Int. Cl.

| | |
|---|---|
| ***B66D 1/30*** | (2006.01) |
| ***B63B 21/00*** | (2006.01) |
| ***B66D 1/22*** | (2006.01) |
| ***B63B 21/16*** | (2006.01) |
| ***B66D 1/74*** | (2006.01) |

(52) U.S. Cl.

CPC ..... *B66D 1/30* (2013.01); *B63B 21/00* (2013.01); *B63B 21/16* (2013.01); *B66D 1/22* (2013.01); *B66D 1/7426* (2013.01); *B63B 2021/003* (2013.01)

(58) Field of Classification Search

CPC ... B66D 1/22; B66D 1/40; B66D 1/39; B66D 1/7426; B63B 2021/003; B63B 21/16

See application file for complete search history.

(56) References Cited

U.S. PATENT DOCUMENTS 3,162,424 A * 12/1964 Hatlapa ..... B66D 1/48 254/274
3,398,820 A * 8/1968 Alfred ..... B66D 1/12 192/35
3,476,361 A * 11/1969 Herchenroder ..... B63B 21/16 254/329

(Continued)

FOREIGN PATENT DOCUMENTS

JP H0268291 A 3/1990
KR 20140005534 U 10/2014

OTHER PUBLICATIONS

Search Report & Written Opinion for IT 102018000003407 filed on behalf of Harken Italy S.P.A. on Mar. 9, 2018. dated Nov. 13, 2018. 7 pages.

*Primary Examiner* — Emmanuel M Marcelo
(74) *Attorney, Agent, or Firm* — Steinfl + Bruno LLP

(57) ABSTRACT

A retractable warping winch with a supporting housing, adapted to be stably fixed to a deck of a vessel at an opening thereof, and a bell, including a base and a drum integral to each other. The bell is movably supported by the housing so that it can vertically shift therein between an extracted working position and a retracted rest position. The winch also includes a driving mechanism to rotate the bell, including a motor and a transmission. The driving mechanism includes a drive hub mounted in the housing. The base of the bell is mounted in the drive hub to be rotatably integral therewith and free to axially shift with respect thereto. The drive hub is mounted in the housing to be rotatably free and axially constrained thereto. The motor is mounted on the housing, externally and laterally thereto.

12 Claims, 9 Drawing Sheets

(56) References Cited

U.S. PATENT DOCUMENTS

| | | | | |
|---|---|---|---|---|
| 4,548,540 | A * | 10/1985 | Renfro | B62D 43/045 206/304 |
| 6,120,234 | A * | 9/2000 | Dinverno | B25H 3/00 14/71.1 |
| 9,676,481 | B1 * | 6/2017 | Buchmueller | G05D 1/0204 |
| 10,640,344 | B1 * | 5/2020 | Hall | B60D 1/38 |
| 2013/0292619 | A1 * | 11/2013 | Elmbo | B66D 1/7426 254/323 |
| 2016/0060083 | A1 * | 3/2016 | Klinke | B63B 27/08 414/800 |
| 2018/0257917 | A1 * | 9/2018 | Hall | B66D 1/38 |

* cited by examiner

RETRACTABLE WARPING WINCH

CROSS REFERENCE TO RELATED APPLICATIONS

The present application claims priority to Italian patent application No. 102018000003407 filed on Mar. 9, 2018, which is incorporated herein by reference in its entirety.

FIELD

The present invention refers to a warping winch, i.e. a winch intended to be used aboard vessels to provide help to the crew in the operations that involve the application of traction on a mooring rope. This is indeed the case of warping operations, in which a vessel is moved by means of the traction force on one or more mooring ropes, for example while approaching a quay. Hereinafter, sometimes only the term "winch" may be used, without specifying "warping", thereby still meaning a warping winch.

BACKGROUND

A warping winch essentially comprises a bell able to be set in rotation by means of a motor. In use, the rope is wound on the bell for a few turns and kept under tension manually by an operator on the free side (i.e. that not intended to be subjected to traction to move the vessel); the motor is thus driven so that the bell transmits the work traction to the rope by friction. The tension applied manually by the operator on the free side is used to ensure that between bell and rope there is sufficient friction to transmit the necessary work traction to the rope.

A winch of this type must of course be mounted aboard the vessel in a suitable position, so as to allow the rope to be placed under traction without interfering with obstacles of any kind. It is thus generally positioned on the deck, generally at the bow or stern, close to the outer edge of the vessel, with the motor mounted below deck and connected to the bell by a transmission, so as to be able to set it in rotation during use.

The size of the winch can even be very large, when the vessel is large and heavy. In these cases, but not only these, the winch can constitute a bulky presence on the deck of the vessel. This drawback is particularly problematic because the time in which the warping winch is used is normally much shorter than the time in which it is not used, whereas the bulk is permanent.

For this reason, retractable warping winches have been made, in which the bell can be made to withdraw into a housing built into the deck when it is not used, i.e. in a rest position; on the other hand, when the winch must be used, the bell is extracted into a working position projecting from the deck, thus taking up a position analogous to that of a normal fixed winch. A retractable winch is described for example in Italian patent no. 1393516, which is incorporated herein by reference in its entirety. The bell is axially mobile in the housing, between the rest and work positions, and is set in rotation through a shank arranged axially, constrained to the bell with a prismatic coupling that makes it possible to transmit the rotary motion of the shank to the bell, leaving the bell free to slide axially along the shank. The motor thus sets the shank in rotation.

A retractable winch of this type solves the problem of the bulk on the deck during times when the winch is not in use, but it results in another problem, given by the bulk below deck. In particular, it is necessary to provide not only sufficient space below deck to accommodate the bell, but also the space to ensure a solid support of the bell in working position, as well as the space for the motor for driving the shank.

As clearly shown in the aforementioned patent, all of these bulks extend particularly in the axial direction, resulting in an axial bulk below deck equal to four/five times the useful axial extension of the bell. This is a very different situation from that of a normal fixed winch, where the space below deck is taken up substantially by only the motor and it does not normally exceed one or two times the useful axial extension of the bell.

Consequently, known retractable warping winches cannot always be used; where the space below deck is too small, there is no option but to use a fixed winch, permanently projecting on deck.

Consequently, there is the problem of providing a retractable warping winch that has limited bulk below deck, particularly in the axial direction, given that the free height below deck is often insufficient.

SUMMARY

The present invention concerns a retractable warping winch comprising: a supporting housing, adapted to be stably fixed to a deck of a vessel at an opening thereof, a bell, including a base and a drum integral with one another, the bell being movably supported by the housing so that the bell can vertically shift therein between an extracted working position, in which the drum projects upwardly from the housing and is adapted to be engaged with warping ropes, and a retracted rest position, in which the drum is accommodated in the housing and is substantially flush with the deck, a driving mechanism to rotate the bell, including a motor (like for example an electric or hydraulic motor) and a transmission, wherein the driving mechanism comprises a drive hub mounted in the housing, in which the base of the bell is mounted in the drive hub in such a way as to be rotatably integral therewith and free to axially shift with respect thereto, and in which the drive hub is mounted in the housing in such a way as to be rotatably free and axially constrained thereto; and in that the motor is mounted on the housing, externally and laterally thereto.

This structure with the drive hub, in which the base of the bell is inserted, and with the motor mounted laterally to the housing, makes it possible to limit the axial bulk with respect to the prior art, where the bell is moved thanks to the shank with prismatic coupling. Indeed, whereas in the prior art the actuation of the shank requires the motor to reach the shank itself and thus results in an axial bulk beyond the shank, the drive hub can also be actuated laterally, making it possible to arrange the motor beside the housing. Whereas the bulk in the axial direction can be the cause of difficulties of installation below deck (or even making it impossible), a greater bulk in the radial direction does not create any difficulties, since the motor occupies a space that would in any case be unused.

Preferably, the transmission of the driving mechanism comprises a ring gear, mounted externally on the drive hub and integral with it.

Thanks to this ring gear, the axial bulk is kept low, since it acts on the drive hub laterally. Moreover, it is particularly simple, strong and efficient. Another important advantage is that the large diameter of the ring gear makes it possible to transfer the rotary motion from the motor to the drive hub with a substantial reduction of the rotation speed, without needing further reduction stages.

Preferably, the transmission of the driving mechanism also comprises a pinion, integrally rotatably mounted on an output shaft of the motor and in meshing engagement with the ring gear. Alternatively, the output shaft of the motor can be provided with a worm screw, in meshing engagement with the ring gear.

The axial movement of the bell (lifting into the working position and lowering into the rest position) can be obtained in various ways.

In a first preferred embodiment, the driving mechanism is also adapted to move the bell from the rest position to the working position and vice-versa and comprises:

a threaded column, mounted axially centered on a bottom of the housing and fixed with respect thereto, a threaded nut, mounted axially centered on a bottom of the bell fixed to the base thereof, in meshing engagement with the column, a clutch between the nut and the bottom of the bell.

With this mechanism, a motorized actuation of the bell is thus obtained, by means of the same motor that drives the rotation of the bell. Indeed, the very rotation of the bell results in a simultaneous axial movement thereof, thanks to the coupling between the nut and the column, the presence of the clutch ensures that the bell can be rotated for use (application of the traction to the rope), when the axial movement is no longer possible, because the working position has been reached. The winch is particularly simple to actuate, to the point of being able to be considered automatic, in the sense that the actuation in rotation of the bell also automatically causes the lifting thereof from the rest position to the working position.

In other preferred embodiments, the winch comprises a lifting mechanism for the bell, mounted axially in the housing and acting on the bell. This lifting mechanism is distinct from the driving mechanism. In this way, the need to use a clutch is avoided, which can be unwanted for fear of adjustment problems and possible noise.

In a preferred embodiment, the lifting mechanism is motorized and comprises a linear electric actuator, with a body mounted fixed on a bottom of the housing and a stem axially mobile with respect to the body, pressing from below against a head of the bell, fixed to the top of the drum. This actuation is easy to install (it requires only electrical connections) and ensures reliable operation, practically devoid of annoying noises.

In another preferred embodiment, the lifting mechanism is motorized and comprises a hydraulic actuator, with a cylinder mounted fixed on a bottom of the housing and a piston axially mobile with respect to the cylinder, pressing from below against a head of the bell, fixed to the top of the drum. This actuation is also easy to install, but requires there to be a hydraulic power system aboard; on the other hand, it ensures very high powers and is thus also suitable for winches of very large size, typical of large vessels that are already normally equipped with a hydraulic power system.

In another preferred embodiment, the lifting mechanism is manual and makes it possible to keep the bell in working position or in rest position, as well as to move it with manual action from the working position to the rest position and vice-versa. This is clearly the simplest solution to actuate the axial movements of the bell and is suitable for small vessels, where the weight of the bell is not excessive.

Preferably, the manual lifting mechanism comprises:

a hole, formed centrally in a head of the bell, fixed to the top of the drum, an inner guide tube, fixed lowerly to the head of the bell, at the hole, an outer guide tube, in sliding engagement on the inner guide tube and fixed to the housing, an upper throat, formed peripherally in the outer guide tube, at the upper end thereof, at least one radial seat, formed in the inner guide tube, at the lower end thereof, a mobile abutment, housed in a radially mobile manner in the radial seat and able to engage in the upper throat, a maneuvering stem, slidably mounted axially in the inner guide tube, provided with a main portion having a slightly smaller diameter than the inner diameter of the inner guide tube, with an end portion of small diameter and with a handle, fixed to the end of the stem opposite the portion of small diameter and projecting from the hole above the head of the bell, wherein the maneuvering stem can take up a locked position, in which the main portion is in front of the radial seat and pushes the mobile abutment in the upper throat of the outer guide tube, and an unlocked position, in which the end portion is in front of the radial seat and leaves the mobile abutment free to disengage from the upper throat, a spring system, to elastically push the maneuvering stem towards the locked position thereof.

This configuration has proven easy to make and reliable in operation. The bell is kept in working position by the engagement of the mobile abutment in the upper throat, and in the rest position by the weight of the bell itself.

Possibly, the manual lifting mechanism can also comprise a lower throat, formed peripherally in the outer guide tube, at the lower end thereof. In this way, the bell can be held safely in the rest position thereof even in the presence of strong oscillations and rocking (for example in the case of particularly rough seas).

Preferably, the spring system comprises:

a ring nut, mounted on the end portion of the maneuvering stem, a spring, mounted around the maneuvering stem, compressed between the ring nut and the inner guide tube.

The bell can have a conventional configuration, so as to comprise a bottom, a cylindrical monolithic structure (hollow or solid) fixed onto the bottom and a head fixed onto the monolithic structure, wherein the monolithic structure forms the base and the drum of the bell, wherein the base of the bell and the drive hub are shaped in such a way as to form a prismatic coupling which makes them rotatably integral to each other, but free in an axial direction.

According to a particular embodiment of the invention, the bell comprises a bottom, a cloister formed by a plurality of columns fixed onto the bottom and a head fixed onto the cloister, wherein the cloister forms the base and the drum of the bell, wherein the drive hub comprises seats for accommodating the columns of the cloister with play. This configuration is particularly suitable for a winch according to the invention, since the cloister structure itself ensures the ideal type of coupling between drive hub and bell, with freedom of movement in the axial direction and constraint in rotation.

BRIEF DESCRIPTION OF THE DRAWINGS

Further characteristics and advantages of the invention will become clearer from the following description of some preferred embodiments thereof, made with reference to the attached drawings. In such drawings.

DETAILED DESCRIPTION

FIGS. 1 to 5 show a retractable warping winch 10 according to a first embodiment of the invention; the winch 10 is mounted on a deck C (only partially visible).

The winch 10 comprises a supporting housing 20, intended to be rigidly mounted on the deck C, at an opening A thereof. The fixing of the housing 20 to the deck C is carried out in a per se conventional way (for example through screws or tie rods) and it is not illustrated in the figures. The housing 20 lowerly comprises a bottom 21.

Figure 17:
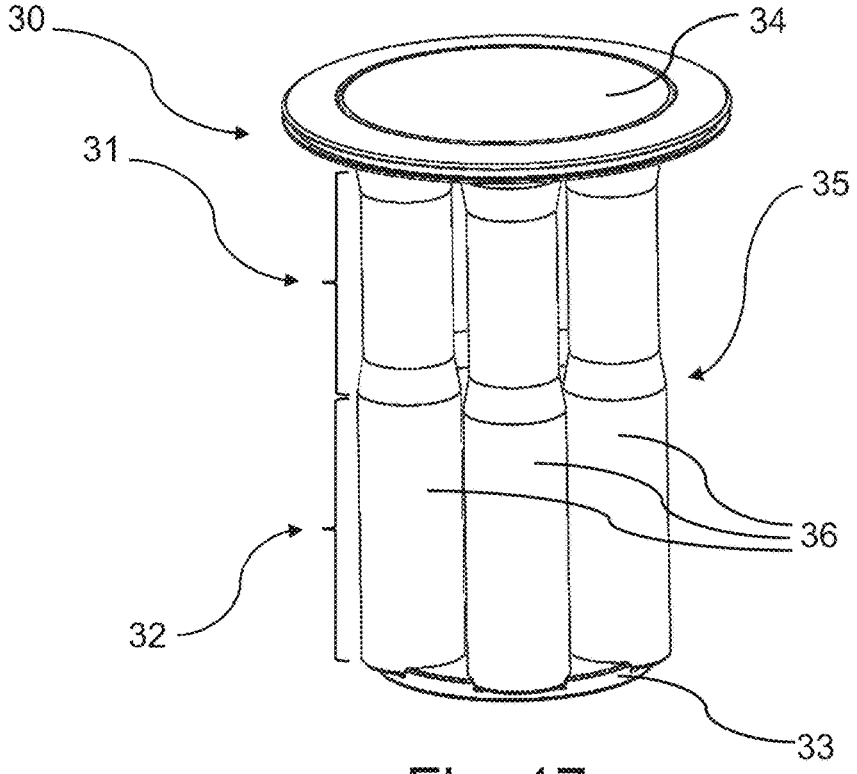
FIG. 17 is a perspective view of only the bell of the winch of FIGS. 1-5, as well as of the same bell of the winch of FIGS. 9-10, 11-12 and 13-16.

The winch 10 then comprises a bell 30, also illustrated in FIG. 17, isolated from the winch 10, comprising a drum 31 integral above a base 32. The base 32 of the bell 30 is movably supported in the housing 20 so that the bell 30 can shift axially vertically therein between an extracted working position (shown in FIGS. 2 and 4) and a retracted rest position (shown in FIGS. 1 and 3). In the working position, the drum 31 projects upwardly from the housing 20 and is adapted to be engaged with warping ropes (not illustrated), whereas the base 32 is held in the housing 20 and thus ensures the solidity of the bell 30 as a whole. In the rest position, on the other hand, the drum 31 is accommodated in the housing 20 and is substantially flush with the deck C.

The bell 30 also comprises a bottom 33, fixed to the base 32 below it, and a head 34, fixed to the drum 31 above it. Moreover, the bell 30 comprises a cloister 35, formed by a plurality of columns 36, in particular five columns 36. The cloister 35 forms at the same time both the base 32 and the drum 31 of the bell 30. The cloister 35 is fixed to the bottom 33 and to the head 34, in particular each column 36 is fixed at the top to the head 34 through a screw 37 and at the bottom to the bottom 33 through a screw 38. Basically, the columns 36, the bottom 33 and the head 34 form the bell 30 as a structurally single assembly.

The winch 10 also comprises a driving mechanism 40 to set the bell 30 in rotation. The driving mechanism 40 comprises a motor 41, which is mounted externally and laterally on the housing 20 and is provided with an output shaft (or drive shaft) 42. The driving mechanism 40 also comprises a drive hub 44, mounted in the housing 20, as well as a ring gear 45 mounted externally on the drive hub 44 and a pinion 46 mounted on the output shaft 42; the pinion 46 is in meshing engagement with the ring gear 45, through a window 24, made laterally in the housing 20. In this way, a motion transmission from the motor 41 to the drive hub 44 is made, by means of the output shaft 42, the pinion 46 and the ring gear 45; the gear ratio from the output shaft 42 to the drive hub 44 is equal to the numerical ratio between the number of teeth of the pinion 46 and the number of teeth of the ring gear 45, and can be selected very low, so that a relatively high rotation speed of the output shaft 42 corresponds to a relatively low rotation speed of the drive hub 44.

The ring gear 45 is mounted on the drive hub 44 through screws 47 with which the ring gear 45 is fixed to an outer flange 48 of the drive hub 44.

The drive hub 44 is rotatably mounted in the housing 20 through two bearings 22, preferably of the roller type, which have a limited radial bulk and ensure a high ability to withstand radial stresses. A flange 23, mounted on the housing 20, on the other hand, prevents the movement of the drive hub 44 in the axial direction.

The drive hub 44 accommodates the bell 30 so as to be rotatably integral therewith, on the other hand keeping a freedom of movement in the axial direction. In particular, the drive hub 44 comprises seats 49 to accommodate the columns 36 of the cloister 35 with play, so that each column 36 can slide freely in its seat 49 in the axial direction. Consequently, the bell 30 is rotatably integral with the drive hub 44 and free to shift in the axial direction.

The driving mechanism 40 of the winch 10 is thus adapted for setting the bell 20 in rotation, through the drive hub 44 that can be set in rotation by the motor 41, as explained above.

The driving mechanism 40 of the winch 10 is also adapted for shifting the bell 20 from the rest position to the working position and vice-versa, i.e. for shifting it in the axial direction. For this purpose, the driving mechanism 40 comprises a threaded column 51, mounted axially centered on the bottom 21 of the housing 20 and fixed with respect thereto, and a threaded nut 52, in meshing engagement with the column 51; an end stop washer 53 is fixed on top of the column 51. The nut 52 is mounted axially centered on the bottom 33 of the bell 30 with interposition of a clutch 54 (better visible in FIG. 5), which comprises a friction washer 55 pushed against the bottom 33 by an axial spring 56, compressed between the friction washer 55 and a flange 57 mounted on the nut 52 with the help of an elastic ring 58.

In the operation of the winch 10, when the bell 30 is set in rotation, the bottom 33 thereof also rotates and with it the nut 52; by rotating, due to the engagement with the column 51, the nut 52 shifts axially along the column 51, thus causing a corresponding axial movement of the bell 30; due to the low stresses in play, the clutch 54 does not slip and actually the driving mechanism 40 behaves as if the nut 52 was integral with the bottom 33 of the bell 30. In particular, starting from the rest position (FIGS. 1 and 3), the bell 30 rises, coming out from the housing 20 with the drum 31, until the working position is reached (FIGS. 2 and 4); in this position, the nut 52 abuts against the washer 53 and cannot move further in the axial direction. Consequently, at this point, any subsequent rotation of the bell 30 under the action of the motor 41 is not prevented, but causes a slipping of the clutch 54.

Therefore, once the bell 30 is in the working position, with the drum 31 outside of the housing 20, the winch 10 can be used for its purpose, i.e. to provide a tension to a rope wound on the drum 31 and thus carry out the desired warping maneuvers. It should be noted that in use the particular shape of the bell 30, with the cloister 35 of columns 36, promotes the friction with the rope that is wound there and thus the transmission of stresses from the bell 30 to the rope.

Once the warping maneuvers are complete and thus the use of the winch 10 has ended, an inversion of the rotation of the motor 41 results in a rotation in reverse of the bell 30 and thus the immediate lowering thereof, thanks to the engagement of the nut 52 on the column 51, until it reaches the rest position.

Figure 1:
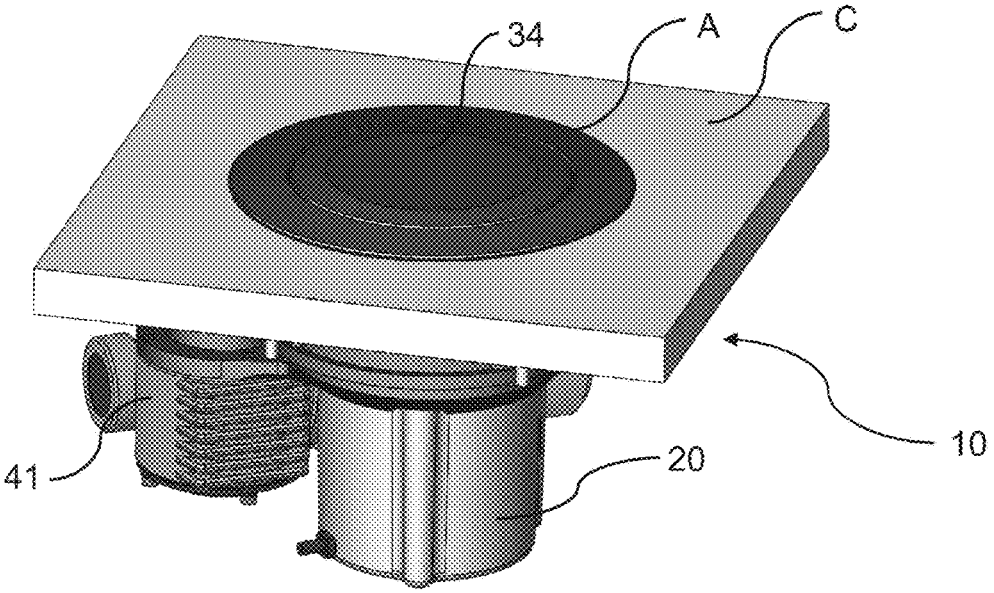
FIG. 1 is a perspective view of a retractable warping winch according to a first embodiment of the invention mounted on a deck (partially visible), in rest position.
Figure 2:
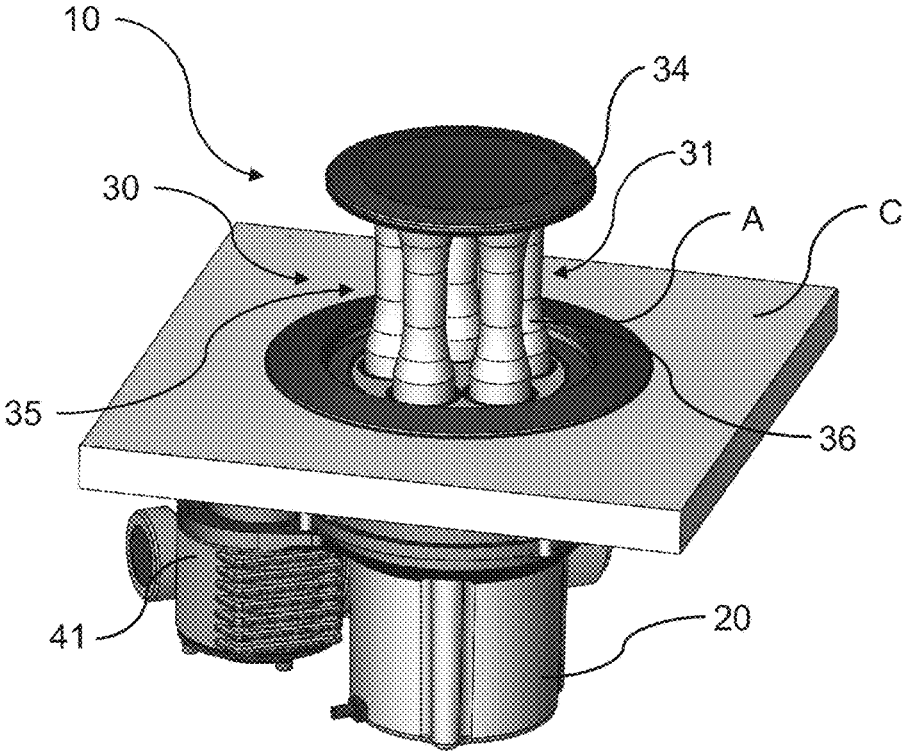
FIG. 2 is a perspective view of the winch of FIG. 1, in working position.
Figure 3:
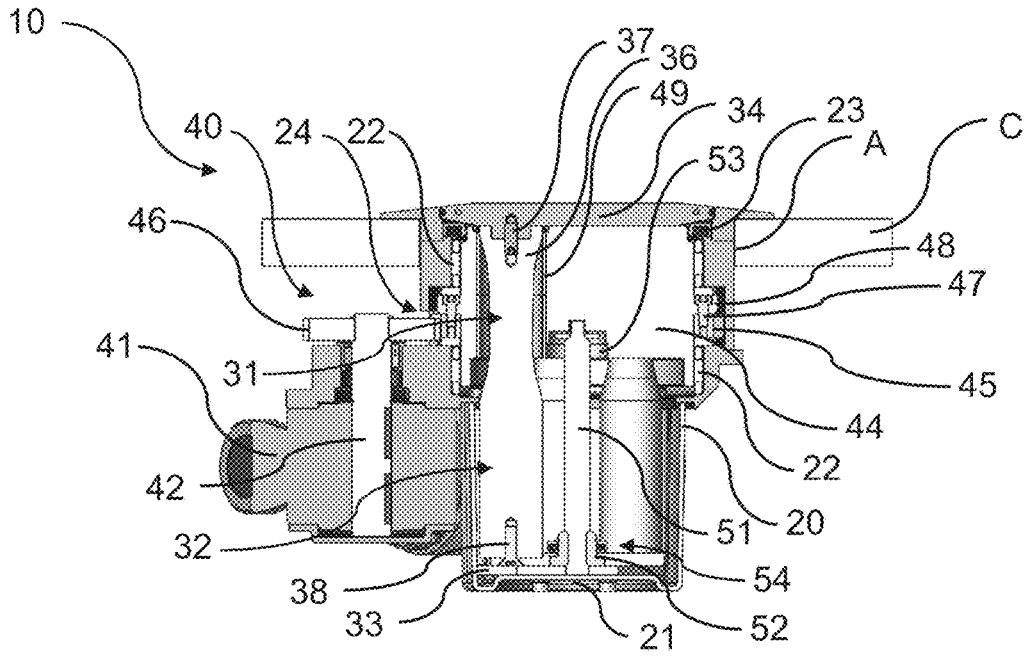
FIG. 3 is a section view of the winch of FIG. 1, in rest position.
Figure 4:
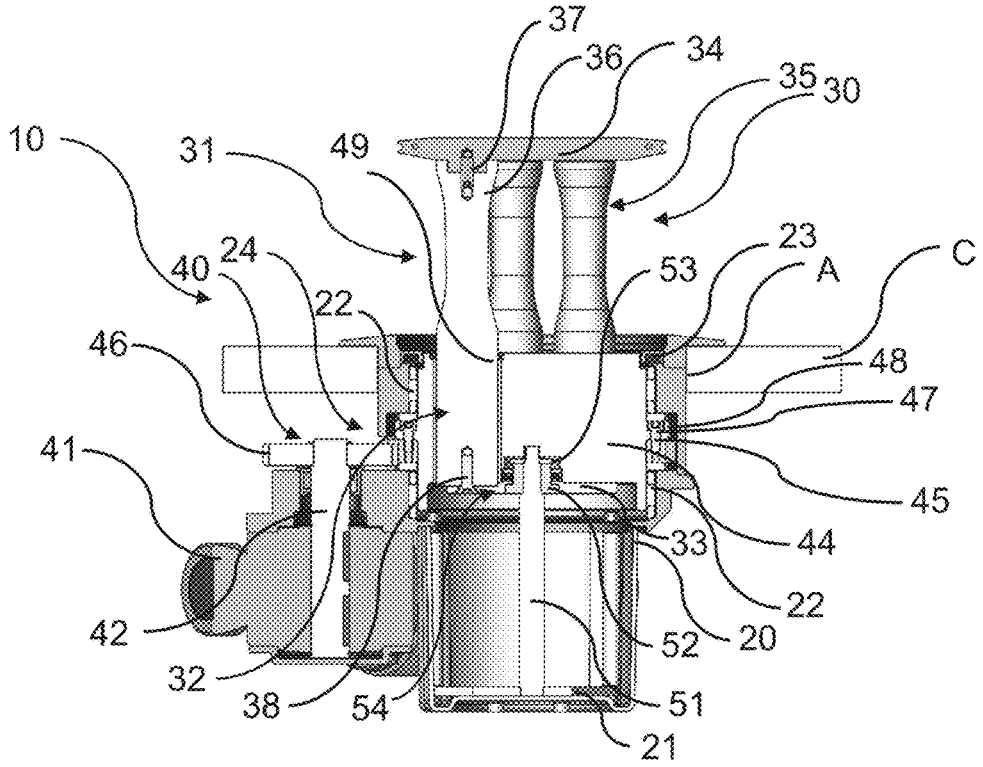
FIG. 4 is a section view of the winch of FIG. 1, in working position.
Figure 5:
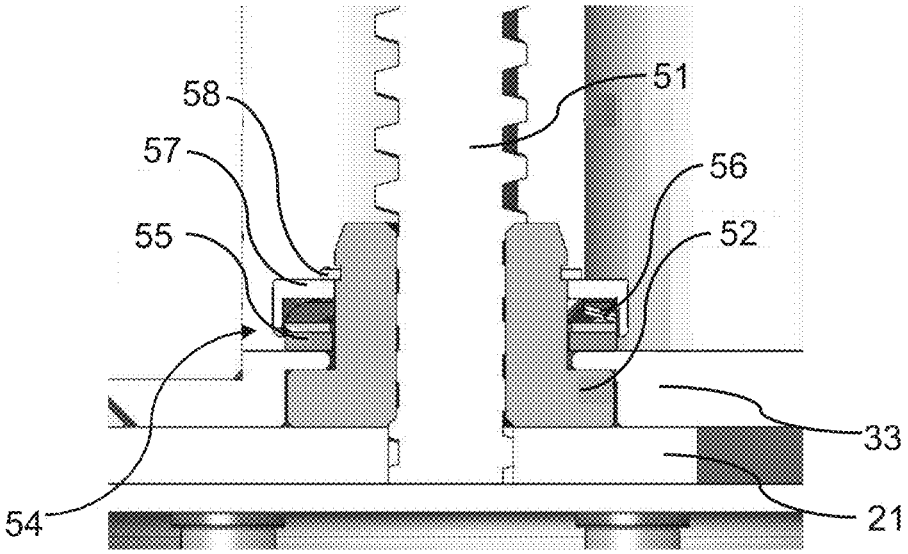
FIG. 5 is a section view of a detail of the winch of FIG. 1.
Figure 6:
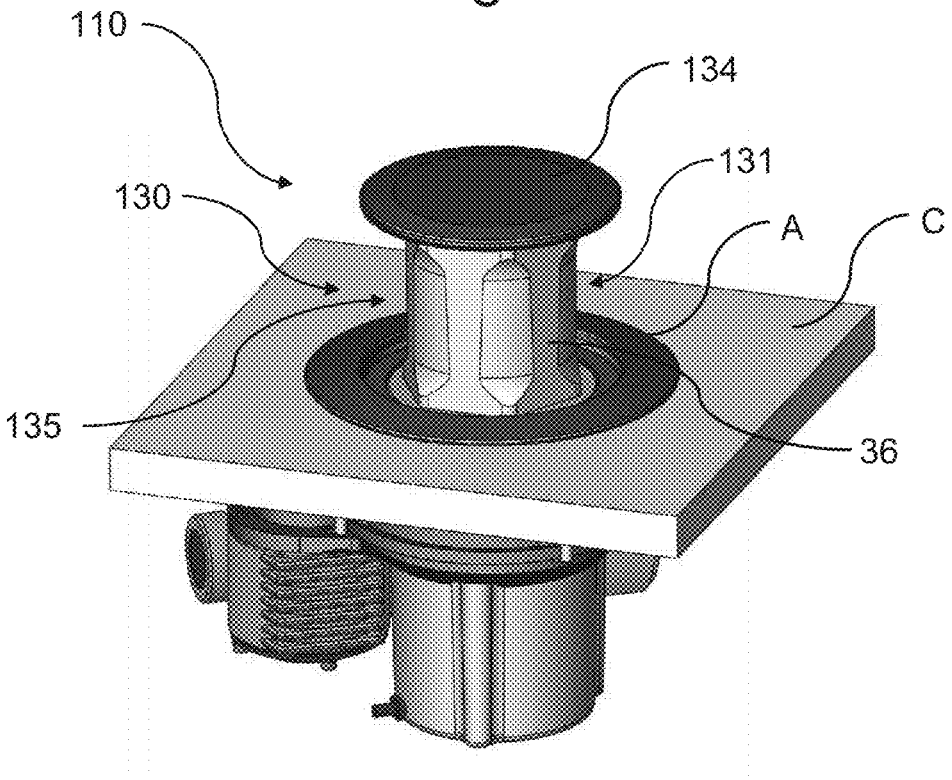
FIG. 6 is a perspective view of a retractable warping winch according to a second embodiment of the invention mounted on a deck (partially visible), in working position.
Figure 7:
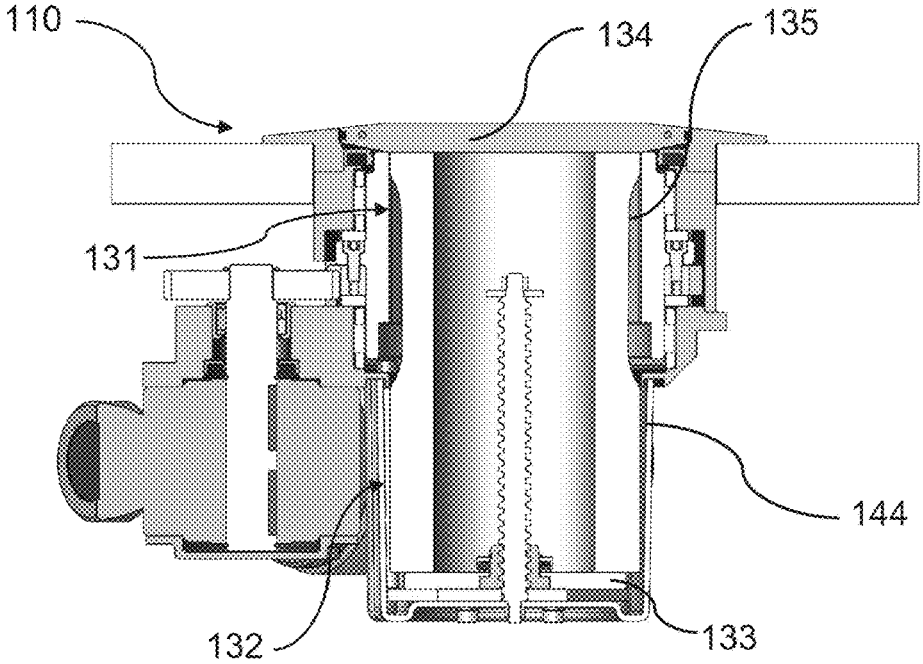
FIG. 7 is a section view of the winch of FIG. 6, in rest position.
Figure 8:
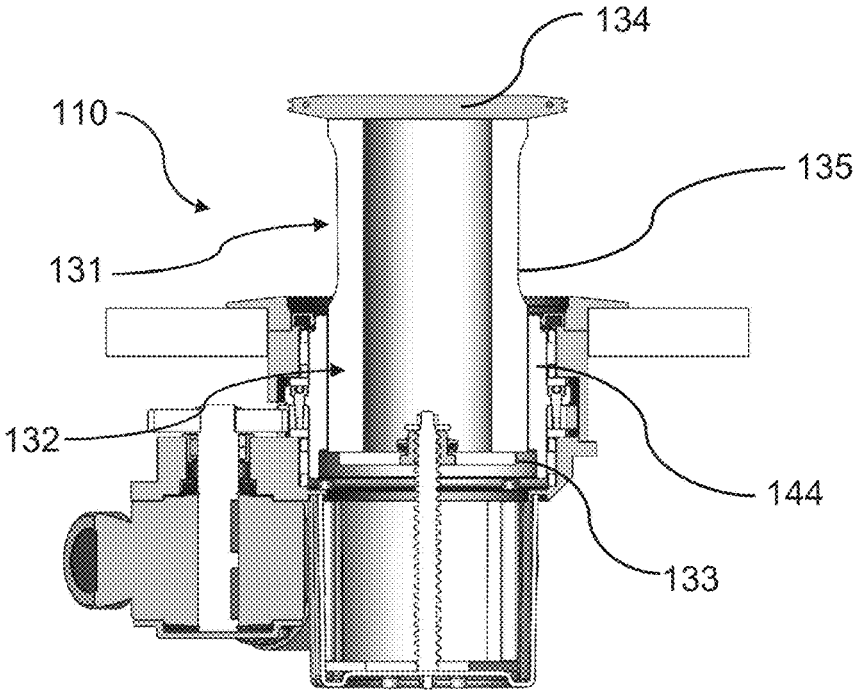
FIG. 8 is a section view of the winch of FIG. 6, in working position.

FIGS. 6, 7 and 8 illustrate a winch 110 according to a second embodiment of the invention. The winch 110 differs from the winch 10 by the structure of the bell and of the drive hub. Hereinafter, the winch 110 will be described only in relation to the parts thereof that are different with respect to the corresponding parts of the winch 10; such different parts will be marked by reference numerals increased by 100 with respect to those of the corresponding parts of the winch 10, whereas the parts that remain the same will not be described in detail and will be marked by the same reference numerals.

Figure 18:
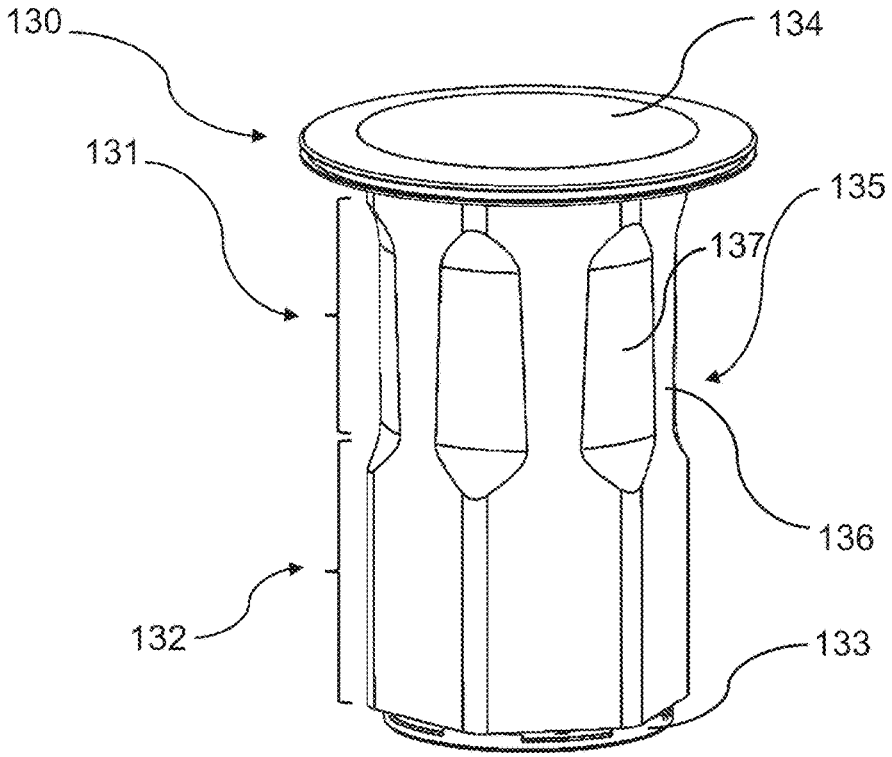
FIG. 18 is a perspective view of only the bell of the winch of FIGS. 6-8.

In the winch 110, the bell 130 also illustrated in FIG. 18, isolated from the winch 110, has a more conventional structure and comprises a bottom 133, a hollow cylindrical monolithic structure 135 fixed on the bottom 133 and a head 134 fixed on the monolithic structure 135. The monolithic structure 135 forms the drum 131 and the base 132 of the bell 130; at the drum 131, the outer surface of the bell 130 is provided with ribs 136 and with flattenings 137, to promote the engagement with the rope that must be wound there. The base 132 of the bell 130 and the drive hub 144 are shaped in such a way as to form a prismatic coupling, which makes them rotatably integral to each other, but free in an axial direction.

The operation of the winch 110 is totally the same as that of the winch 10.

Figure 9:
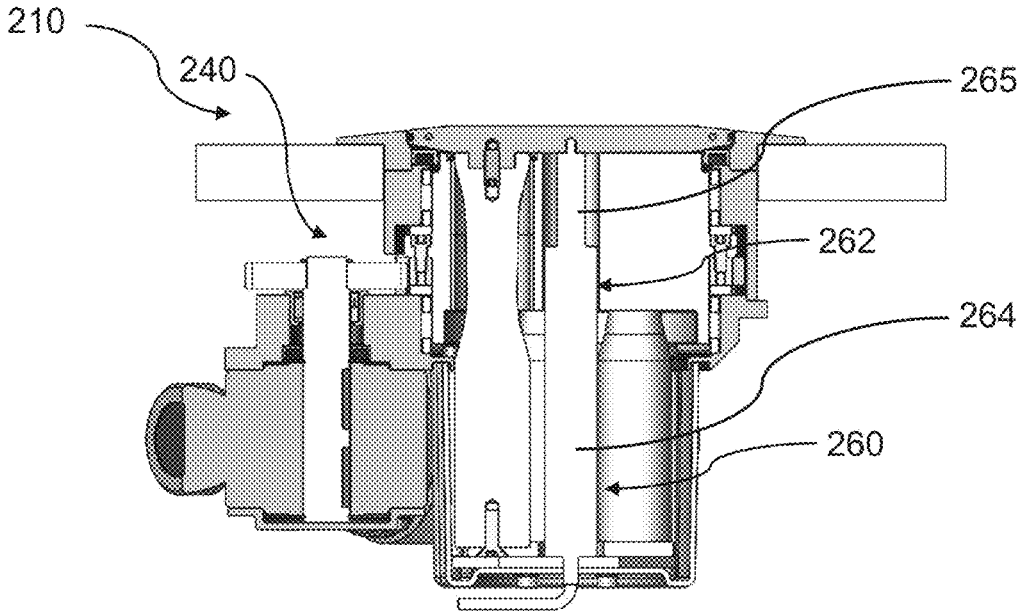
FIG. 9 is a section view of a retractable warping winch according to a third embodiment of the invention mounted on a deck (partially visible), in rest position.
Figure 10:
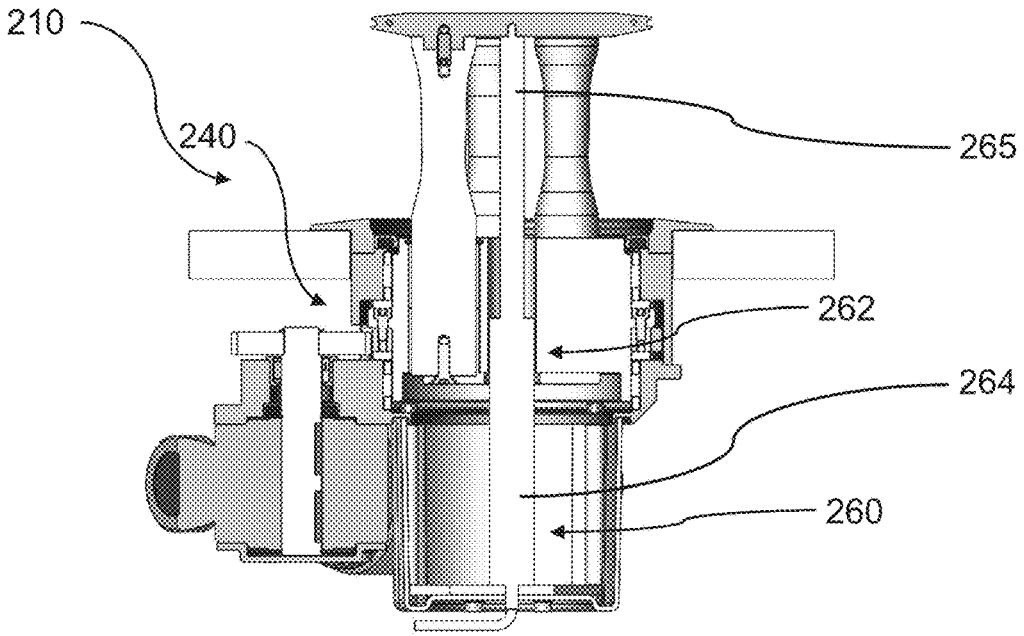
FIG. 10 is a section view of the winch of FIG. 9, in working position.

FIGS. 9 and 10 illustrate a winch 210 according to a third embodiment of the invention. The winch 210 differs from the winch 10 because the driving mechanism is not used also for lifting the bell; vice-versa, for such a function, the winch 210 is provided with a specific lifting mechanism 260. Hereinafter, the winch 210 will only be described in relation to the parts thereof that are different with respect to the corresponding parts of the winch 10; such different parts will be marked by reference numerals increased by 200 with respect to those of the corresponding parts of the winch 10, whereas the parts that remain the same will not be described in detail and will be marked by the same reference numerals.

In the winch 210, the driving mechanism 240 does not comprise the elements that in the winch 10 are marked with numerals from 51 to 58; otherwise, it is the same as the driving mechanism 40. Moreover, the lifting mechanism 260 of the winch 210 comprises a linear electric actuator 262, which comprises a body 264 and a stem 265; the body 264 is mounted on the bottom 21 of the housing 20, arranged axially upwards (in the position occupied by the column 51 in the winch 10), whereas the stem 265 comes out axially from the body 264 upwards and presses at the bottom against the head 34 of the bell 30.

In operation, the actuation of the bell 30 is the same as what is provided for in the winch 10. Differently, the movement of the bell 30 from the rest position to the working position and vice-versa is obtained by actuating the linear electric actuator 262, which directly moves the bell 30 in the axial direction between the two positions.

Figure 11:
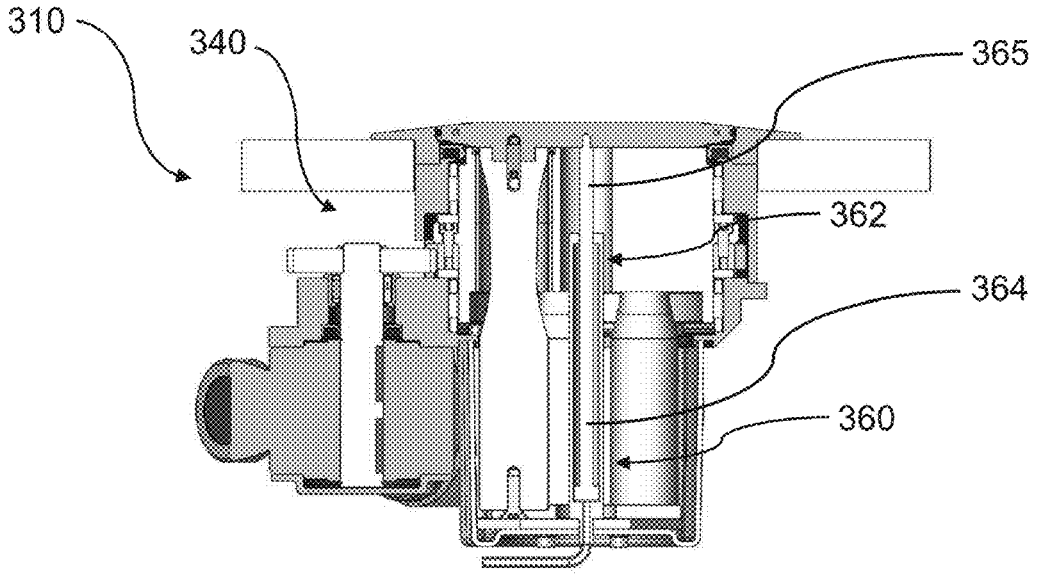
FIG. 11 is a section view of a retractable warping winch according to a fourth embodiment of the invention mounted on a deck (partially visible), in rest position.
Figure 12:
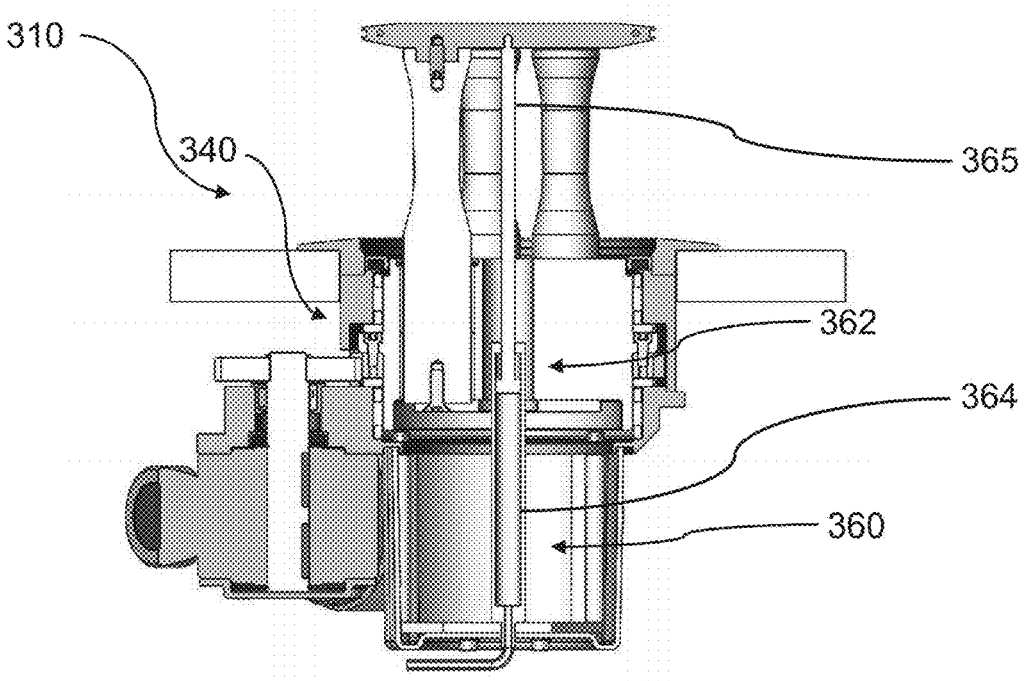
FIG. 12 is a section view of the winch of FIG. 11, in working position.
Figure 13:
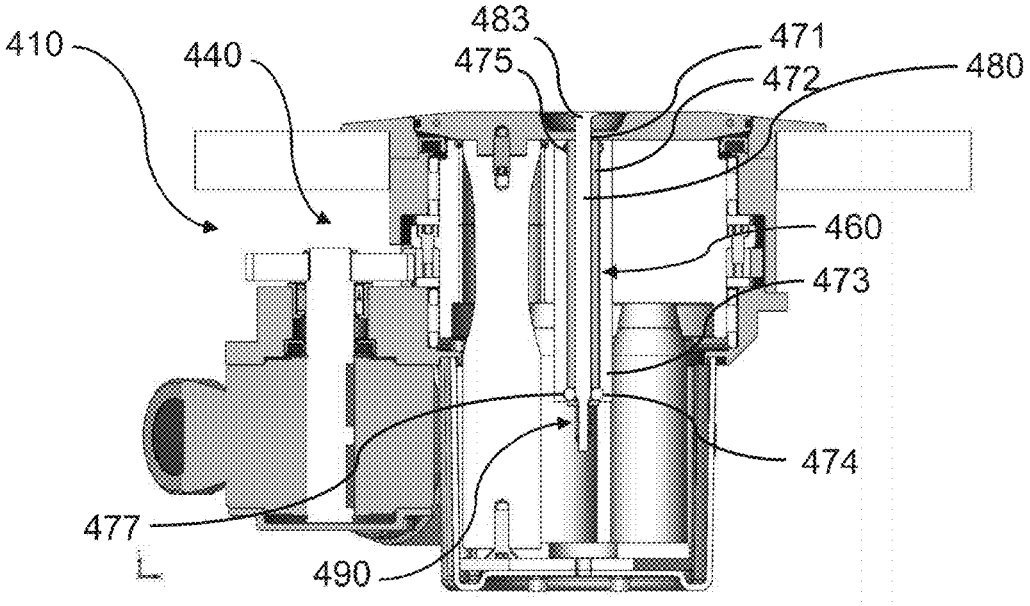
FIG. 13 is a section view of a retractable warping winch according to a fifth embodiment of the invention mounted on a deck (partially visible), in rest position.
Figure 14:
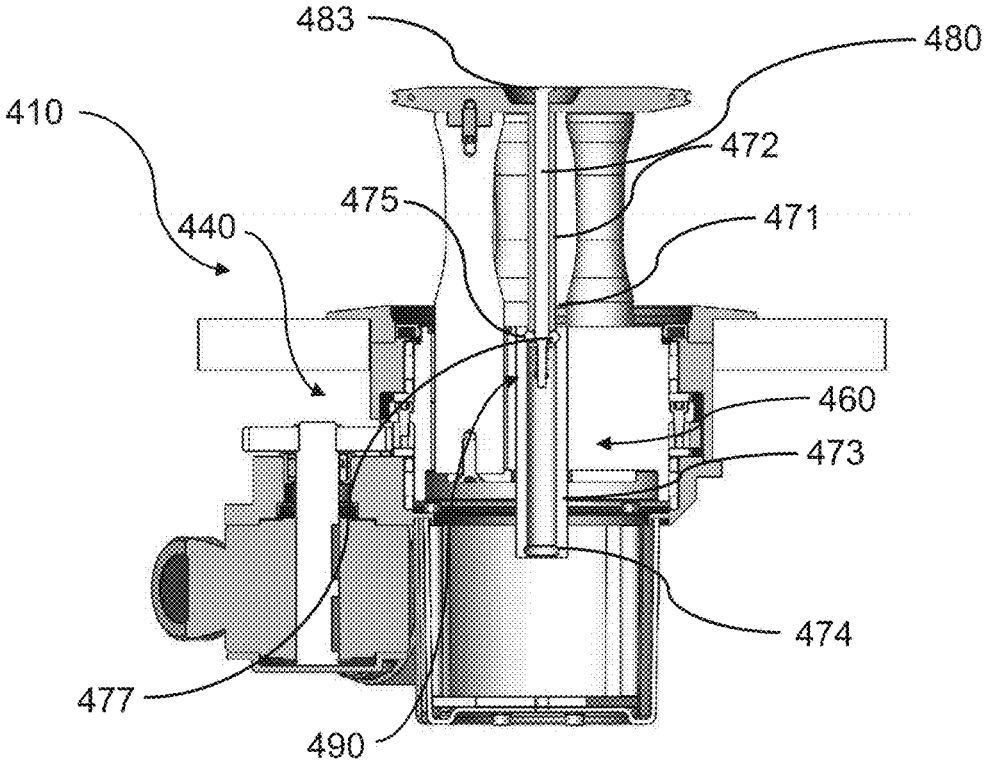
FIG. 14 is a section view of the winch of FIG. 13, in working position.
Figure 15:
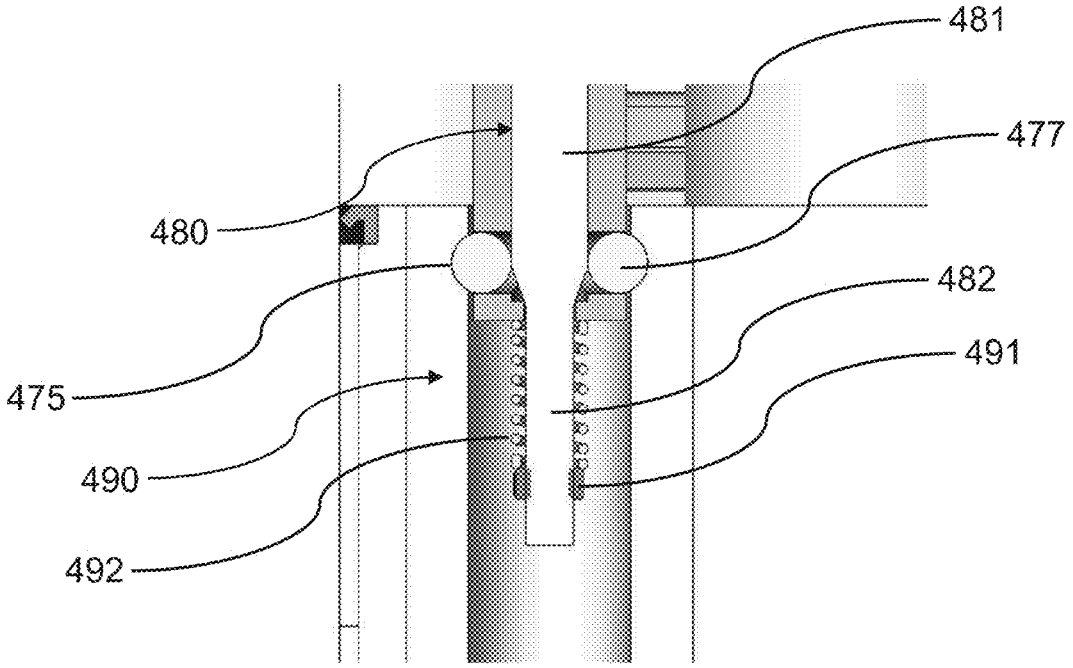
FIGS. 15 and 16 are section views of a detail of the winch of FIG. 13, in two different operative conditions.
Figure 16:
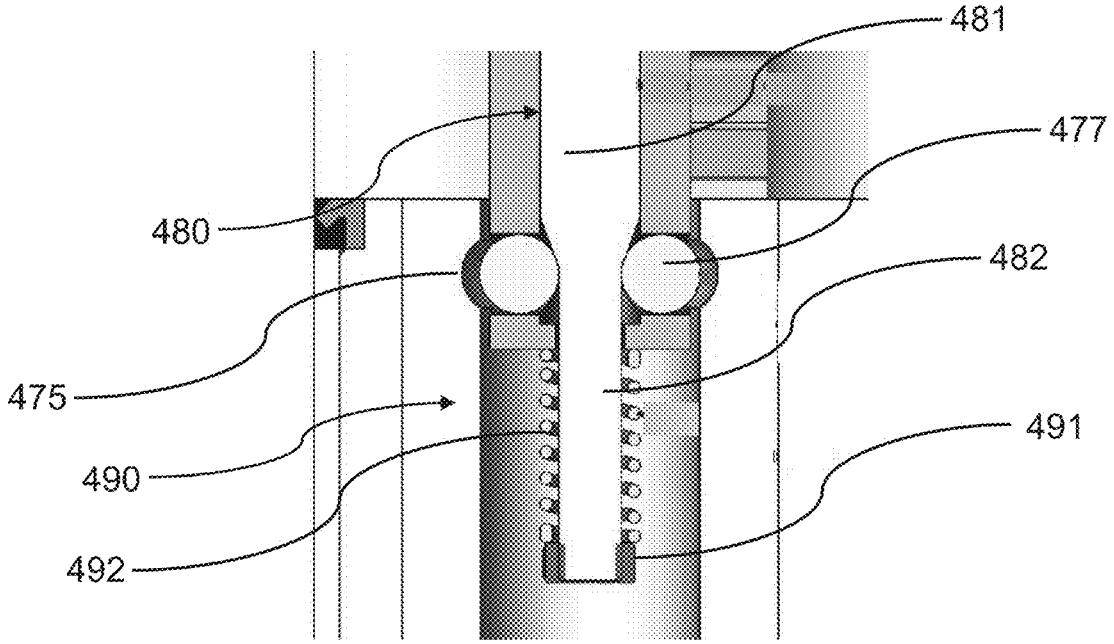

FIGS. 11 and 12 illustrate a winch 310 according to a fourth embodiment of the invention. The winch 210 differs from the winch 10 because the driving mechanism—like in the winch 210—is not used also for lifting the bell; vice-versa, for such a function, the winch 310 is provided with a specific lifting mechanism 360. Hereinafter, the winch 310 will be described only in relation to the parts thereof that are different with respect to the corresponding parts of the winch 10; such different parts will be marked by reference numerals increased by 300 with respect to those of the corresponding parts of the winch 10, whereas the parts that remain the same will not be described in detail and will be marked by the same reference numerals.

In the winch 310, the driving mechanism 340 does not comprise the elements that in the winch 10 are marked with numerals from 51 to 58; otherwise, it is the same as the driving mechanism 40. Moreover, the lifting mechanism 360 of the winch 310 comprises a hydraulic actuator 362, which comprises a cylinder 364 and a piston 365; the cylinder 364 is mounted on the bottom 21 of the housing 20, arranged axially upwards (in the position occupied by the column 51 in the winch 10), whereas the piston 365 comes out axially from the cylinder 364 upwards and presses from below against the head 34 of the bell 30.

In operation, the actuation of the bell 30 is the same as that provided for in the winch 10. Differently, the movement of the bell 30 from the rest position to the working position and vice-versa is obtained by actuating the hydraulic actuator 362, which directly moves the bell 30 in the axial direction between the two positions.

FIGS. 13-16 illustrate a winch 410 according to a fifth embodiment of the invention. The winch 410 differs from the winch 10 because the driving mechanism—like in the winch 210 and in the winch 310—is not used also for lifting the bell; vice-versa, for such a function, the winch 410 is provided with a specific manual lifting mechanism 460. Hereinafter, the winch 410 will only be described in relation to the parts thereof that are different with respect to the corresponding parts of the winch 10; such different parts will be marked by reference numerals increased by 400 with respect to those of the corresponding parts of the winch 10, whereas the parts that remain the same will not be described in detail and will be marked by the same reference numerals.

In the winch 410, the driving mechanism 440 does not comprise the elements that in the winch 10 are marked with numerals 51 to 58; otherwise, it is the same as the driving mechanism 40. Moreover, the lifting mechanism 460 of the winch 410 comprises a hole 471, formed centrally in the head 34 of the bell 30, fixed to the top of the drum; at the bottom of the head 34, at the hole 471, an inner guide tube 472 is fixed, whereas an outer guide tube 473 is mounted in sliding engagement on the inner guide tube 472 and is fixed to the housing 20. A lower throat 474 and an upper throat 475 are formed peripherally in the outer guide tube 473, at the lower end thereof and at the upper end thereof, respectively.

At least one radial seat, in particular two radial seats 476, opposite one another, are formed in the inner guide tube 472, at the lower end thereof. A mobile abutment 477 is housed in a radially mobile manner in each radial seat 476 and can be engaged in the upper throat 475 and in the lower throat 474; preferably, the mobile abutment is a ball.

The lifting mechanism 460 also comprises a maneuvering stem 480, which is mounted in an axially slidable manner in the inner guide tube 472 and is provided with a main portion 481 having diameter slightly smaller than the inner diameter of the inner guide tube 472, and with an end portion 482 having a small diameter; the maneuvering stem 480 is also provided with a handle 483, which is fixed to the end of the maneuvering stem 480 opposite to the end portion 482 and projects from the hole 471 above the head 34 of the bell 30. The maneuvering stem 480 can take up a locked position (FIG. 15), in which the main portion 481 is in front of the radial seats 476 and pushes the mobile abutments 477 into one among the upper throat 475 and the lower throat 474 of the outer guide tube 473, and an unlocked position, in which the end portion 482 is in front of the radial seats 476 and leaves the mobile abutments 477 free to disengage from the upper and lower throat 475, 474.

The lifting mechanism 460 also comprises a spring system 490, to elastically push the maneuvering stem 480 towards the locked position thereof. The spring system 490 comprises a ring nut 491, mounted on the end portion 482 of the maneuvering stem 480, and a spring 492, mounted around the maneuvering stem 480 and compressed between the ring nut 491 and the inner guide tube 472.

In operation, the actuation of the bell 30 is the same as what is provided in the winch 10. Differently, the movement of the bell 30 from the rest position to the working position and vice-versa is obtained through the manual lifting mechanism 460. Starting from the rest position (FIG. 13), lifting the handle 483 causes an axial sliding of the maneuvering stem 480 that from the locked position passes to the unlocked position; the mobile abutments 477 disengage from the lower throat 474 and therefore the operator can continue to lift the handle 483, pulling the entire bell 30 upwards. The mobile abutments 477 slide on the inner surface of the outer guide tube 373, until the upper throat 475 is reached, where they engage pushed by the main portion 481 of the maneuvering stem 480 as soon as the upward traction of the handle 483 is interrupted.

When the mobile abutments 477 are engaged in the upper throat 475, the bell 30 is held in the working position thereof, with the drum 31 extracted from the housing 20, thus able to be used to induce traction on a rope.

In the implementation of the invention, those skilled in the art can of course use a bell like the bell 130 of the winch 110 in the winches 210, 310 and 410.

It should also be noted that the bell 30 is particularly suitable for use in a winch according to the invention, since the cloister structure 35 is suitable for being easily and effectively coupled with the driving drum. The same bell 30, however, can also be used in winches different from the invention, for example in retractable winches of the type described in Italian patent 1393516 quoted above, or in fixed winches.

The invention claimed is:

1. A retractable warping winch comprising:
a supporting housing, adapted to be stably fixed to a deck of a vessel at an opening thereof,
a bell, including a base and a drum integral to each other, the bell being movably supported by the housing so that the bell can vertically shift therein between an extracted working position, where the drum projects upwardly from the housing and is adapted to be engaged with warping ropes, and a retracted rest position where the drum is accommodated inside the housing and is substantially flush with the deck,
a driving mechanism including a motor and a transmission, to rotate the bell,
wherein
the driving mechanism comprises a drive hub mounted inside the housing, wherein the base of the bell is mounted inside the drive hub in such a way as to be rotatably integral therewith and free to axially shift with respect thereto, and wherein the drive hub is mounted inside the housing in such a way as to be rotatably free and axially constrained thereto; and
the motor is mounted on the housing externally and laterally thereto.

2. The winch according to claim 1, wherein the transmission of the driving mechanism comprises:
a ring gear, mounted externally onto the drive hub and integral thereto.

3. The winch according to claim 2, wherein the transmission of the driving mechanism further comprises:
a pinion, integrally rotatably mounted on an output shaft of the motor, and in meshing engagement with the ring gear.

4. The winch according to claim 2, wherein the driving mechanism is also adapted to move the bell from the rest position to the working position and vice versa, and comprises:
a threaded column, mounted axially centered on a bottom of the housing and fixed with respect thereto,
a threaded nut, mounted axially centered on a bottom of the bell that is fixed to the base thereof, in meshing engagement with the column, and
a clutch between the nut and the bottom of the bell.

5. The winch according to claim 3, wherein the driving mechanism is also adapted to move the bell from the rest position to the working position and vice versa, and comprises:
a threaded column, mounted axially centered on a bottom of the housing and fixed with respect thereto,
a threaded nut, mounted axially centered on a bottom of the bell that is fixed to the base thereof, in meshing engagement with the column, and
a clutch between the nut and the bottom of the bell.

6. The winch according to claim 1, comprising a lifting mechanism for the bell, axially mounted inside the housing and acting on the bell.

7. The winch according to claim 6, wherein the lifting mechanism is motorized and comprises a linear electric actuator, with a body fixedly mounted on a bottom of the housing and a stem axially movable with respect to the body, the stem pressing from below against a head of the bell, fixed to the top of the drum.

8. The winch according to claim 6, wherein the lifting mechanism is motorized and comprises a hydraulic actuator, with a cylinder fixedly mounted on a bottom of the housing and a piston axially movable with respect to the cylinder, the piston pressing from below against a head of the bell, the head being fixed to the top of the drum.

9. The winch according to claim 6, wherein the lifting mechanism is manual and allows to maintain the bell in a working position or in a rest position, as well as to manually move the bell from the working position to the rest position and vice versa.

10. The winch according to claim 1, wherein the bell comprises a bottom, a cylindrical monolithic structure fixed on the bottom and a head fixed to the monolithic structure, wherein the monolithic structure forms the base and the drum of the bell, the base of the bell and the drive hub being shaped in such a way as to form a prismatic coupling which makes them rotatably integral to each other, but free in an axial direction.

11. The winch according to claim 1, wherein the bell comprises a bottom, a cloister formed by a plurality of columns fixed onto the bottom and a head fixed to the cloister, the cloister forming the base and the drum of the bell, the drive hub comprising seats to accommodate the columns of the cloister with play.

12. The winch according to claim 1, wherein the driving mechanism is also adapted to move the bell from the rest position to the working position and vice versa, and comprises:

a threaded column, mounted axially centered on a bottom of the housing and fixed with respect thereto, a threaded nut, mounted axially centered on a bottom of the bell that is fixed to the base thereof, in meshing engagement with the column, and a clutch between the nut and the bottom of the bell.

* * * * *